United States Patent [19]

Douglas et al.

[11] 4,177,984

[45] Dec. 11, 1979

[54] CAPTIVE FLYING TOY AIRPLANE HAVING SIMULATED MOTOR SOUNDS

[75] Inventors: Raymond J. Douglas, Carson; Ference Fekete, Huntington Beach; Derek J. Gay, Rancho Palos Verdes; Gary L. Hunter, Fountain Valley; Nicol S. Wilson, Redondo Beach, all of Calif.

[73] Assignee: Mattel, Inc., Hawthorne, Calif.

[21] Appl. No.: 878,853

[22] Filed: Feb. 17, 1978

[51] Int. Cl.[2] ..... A63H 17/34; A63H 27/04

[52] U.S. Cl. ..... 272/31 A; 46/175 R

[58] Field of Search ..... 272/31 A, 31 B, 14; 46/191, 175 R, 111, 204

[56] References Cited

U.S. PATENT DOCUMENTS

| | | | |
|---|---|---|---|
| 1,866,432 | 7/1932 | Urban | 272/31 A |
| 2,114,212 | 4/1938 | Christiansen | 272/31 A |
| 2,149,666 | 3/1939 | Christiansen | 272/31 A |
| 2,219,658 | 10/1940 | Pasek | 272/31 A |
| 3,022,069 | 2/1962 | Pettit | 272/31 A |
| 3,165,860 | 1/1965 | Glass et al. | 46/111 |
| 3,236,008 | 2/1966 | Ryan | 46/111 X |
| 3,286,393 | 11/1966 | Ryan | 46/111 |
| 3,373,505 | 3/1968 | Tucker | 272/31 A X |
| 3,559,333 | 2/1971 | Manzo | 46/175 R |

FOREIGN PATENT DOCUMENTS

| | | | |
|---|---|---|---|
| 941538 | 4/1956 | Fed. Rep. of Germany | 272/31 A |
| 702595 | 1/1931 | France | 46/111 |
| 952515 | 5/1949 | France | 272/31 A |
| 600308 | 4/1948 | United Kingdom | 272/31 A |

*Primary Examiner*—Richard C. Pinkham
*Assistant Examiner*—Arnold W. Kramer
*Attorney, Agent, or Firm*—John G. Mesaros; Max E. Shirk; Ronald M. Goldman

[57] ABSTRACT

A captive flying toy airplane is tethered to a boom pivotally mounted to a turntable for pivoting the boom for altitude adjustment of a toy airplane, the turntable being mounted to a pylon base housing containing drive gears therein. A control housing is provided to position first and second wire control members passing through a tube connected to the housing, one controller of the control housing varying the position of a slide wire rheostat to control the speed of the toy airplane, the second controller pivoting a bell crank through a vertical plane to control the position of an altitude control rod passing through the center of the turntable to effect pivoting of the boom. A sound cone mounted within the pylon has the apex portion engaging a circumferential ratchet surface on one of the drive gears for emitting a simulated motor sound proportional to the speed of rotation of the gear.

4 Claims, 9 Drawing Figures

CAPTIVE FLYING TOY AIRPLANE HAVING SIMULATED MOTOR SOUNDS

BACKGROUND OF THE INVENTION

The background of the invention will be discussed in two parts:

Field of the Invention

This invention relates to captive flying toys and more particularly to a control mechanism for controlling captive flying toy airplanes.

Description of the Prior Art

Toy airplanes that fly around a centrally located pylon have been very popular with children. For the most part, such toy airplanes have included complex mechanical linkages to obtain simulated flying of the toy airplane. In other cases, the propeller was driven and the wings provide the necessary lift to fly the airplane. Such mechanical linkage add cost and unduly complicate the mechanism of the airplane. In some such toy airplane systems, one motor is utilized to rotate the tethered airplane with another motor utilized to control the propeller of the airplane.

Representative captive flying toys are shown in U.S. Pat. Nos. 2,699,334; 2,967,706; 3,556,520; 3,731,424; and 3,762,702 by way of example. There are numerous other captive flying toy devices and the above are listed by way of illustration only.

In any event, it is desirable in such a toy to minimize the complexity to enable to be readily produced at low cost, while incorporating as many functions as possible which would enable it to simulate airplane maneuvers to the maximum extent possible within such constraints. In addition, the toy airplane should be so constructed and so connected to the boom to enhance the safety to the child should the airplane inadvertently impact on the child or other objects.

Accordingly, it is an object of this invention to provide a new and improved captive flying toy airplane.

It is another object of this invention to provide a new and improved captive flying toy airplane having simple yet reliable control mechanisms.

It is a further object of this invention to provide a new and improved coupling for coupling the toy airplane to the boom.

SUMMARY OF THE INVENTION

The foregoing and other objects of the invention are accomplished by providing a captive flying toy airplane secured by a two part coupling to a tether having the other end thereof fixed to a counterweighted boom assembly pivotally coupled to a turntable, the pivot axis of the boom being offset from the center of rotation of the turntable. The turntable is rotatably coupled to a pylon base housing having drive gears therein driven by an electrical motor. A control housing has first and second controllers operating wire control members passing through a plastic tube coupled between the control housing and the pylon base housing, one of such wire control members actuating a slide wire rheostat to control the speed of the motor with the second wire control member operating a bell crank about an axis generally perpendicular to the axis of rotation of the turntable for vertically displacing an altitude control rod extending through the center of the turntable to thereby pivot the boom against the force of the counterweight.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
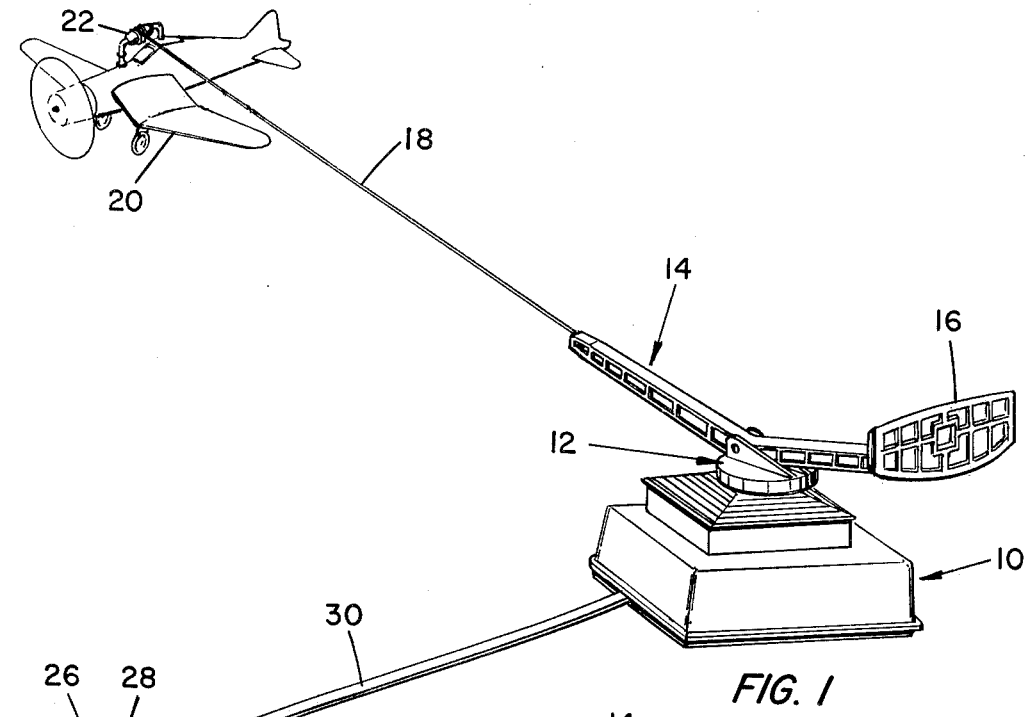
FIG. 1 is a perspective view of the captive flying toy airplane according to the invention.

Referring now to the drawings and particularly to FIG. 1 there is shown a captive flying toy airplane which includes a pylon base housing generally designated 10 having rotatably coupled to the top thereof a turntable 12 to which is pivotally secured a boom 14 having a counterweight 16 on one end thereof with a wire tether 18 coupled to the other end of the boom 14. A toy airplane 20 is secured to the opposite end of the wire tether by means of a coupling member 22. A control housing 24 has first and second controller handles 26 and 28 for controlling the speed and altitute respectively of the airplane 20 during rotation concurrently with the turntable 12. Interconnecting the control housing 24 and pylon base housing 10 is a plastic tube 30 which contains a pair of wire control members 32 and 34 (see FIG. 3) which interconnects in operative relation the controller handles 26 and 28 with the operative components within the base housing 10. The counterweight 16 is molded of a hard rubber type composition which may have additional weight added therein, the counterweight 16 being in the form a scanning radar antenna. By operation of the controller handles 26 and 28, the child can effect rotation of the toy airplane 20 at various speeds and at different altitudes.

Figures 2, 5, 6:
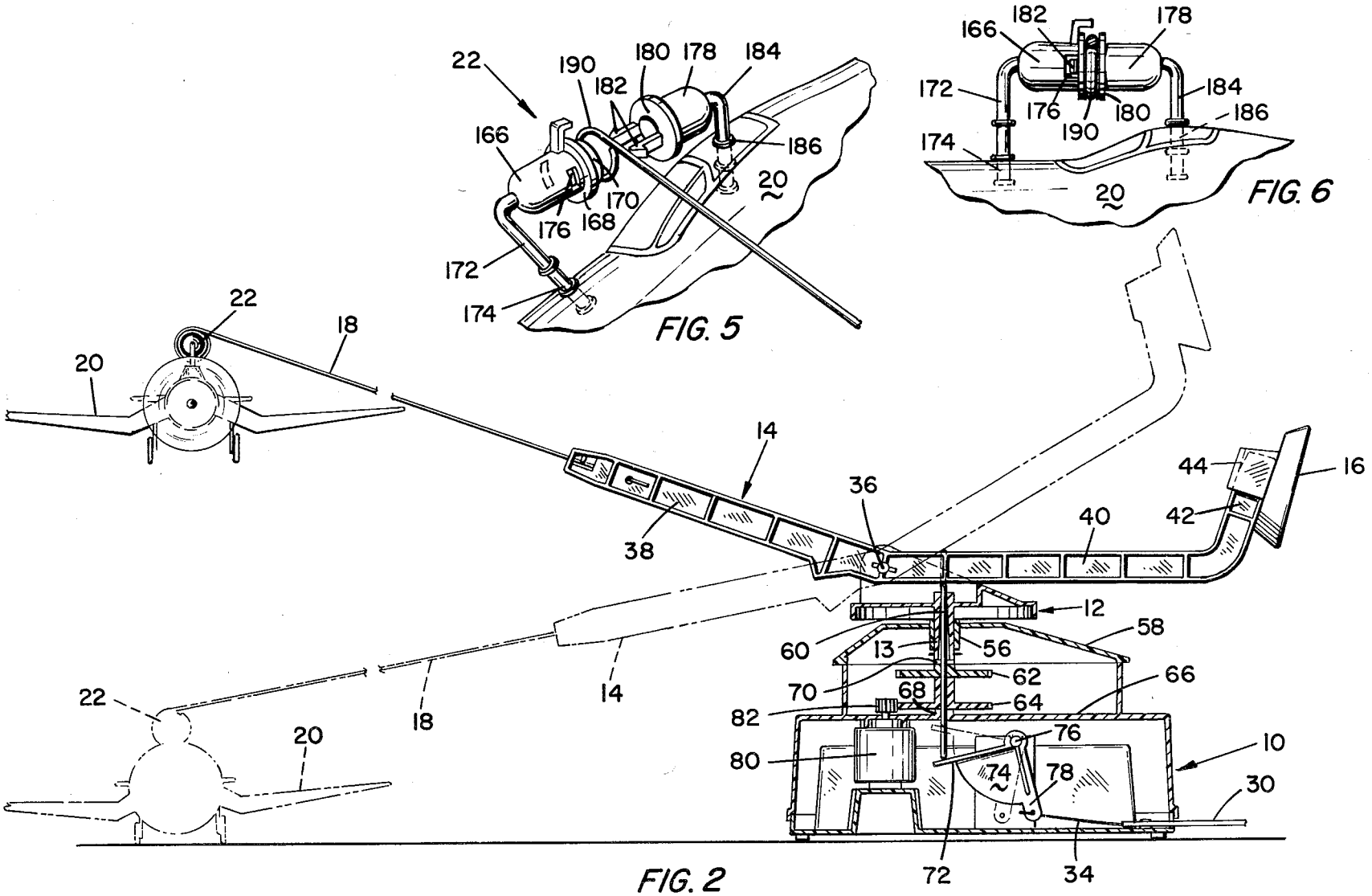
FIG. 2 is a side elevation of the base housing, boom and airplane, partially in cross section and partially broken away, illustrating the movement of the boom in dotted lines.
FIG. 5 is a perspective view, partially broken away, illustrating the coupling member in partial engagement.
FIG. 6 is a side elevation of the coupling member of FIG. 5.

Referring to FIG. 2, the boom 14 is formed in the shape of a structural bar with a bend at the pivot shaft 36 thereof with the first arm 38 having suitable fastening means at the free end thereof for receiving the wire tether 18. The other arm 40 of boom 14 has a bent portion 42 at the free end thereof configured for frictionally engaging an opening form within a cup shaped portion 44 of the counterweight 16. The turntable 12 is generally disc shaped with a pair of upwardly extending generally parallel ear members 46 and 48 having a pair of aligned apertures 50 and 52 respectively formed therein (see also FIG. 4). The upper edges of ear members 46 and 48 are outwardly tapered to enable the pivot shaft 36 of the boom 14 to be urged downwardly to engage the aligned apertures 50 and 52. As shown in FIG. 2, the pivot shaft 36 is disposed generally parallel to the surface 54 upon which the housing 10 rests with the pivot shaft 36 being displaced a distance from the hub portion 13 of the turntable 12, the hub portion 13 being of a length sufficient to pass through a bushing 56 integral with the housing cover 58 of the pylon base housing 10. The hub 13 has an aperture extending therethrough for receiving an altitude control rod 60 which urges against the bottom of arm 40 of boom 14 to pivot boom 14 generally between the solid line position shown in FIG. 2 and the dotted line position wherein the toy airplane 20 is shown in a "landing" or "take-off" position resting on surface 54. The toy airplane 20 may be formed, for examle, of a foam composition material manufactured by a puff molding process to provide a relatively rigid yet flexible object.

Figure 4:
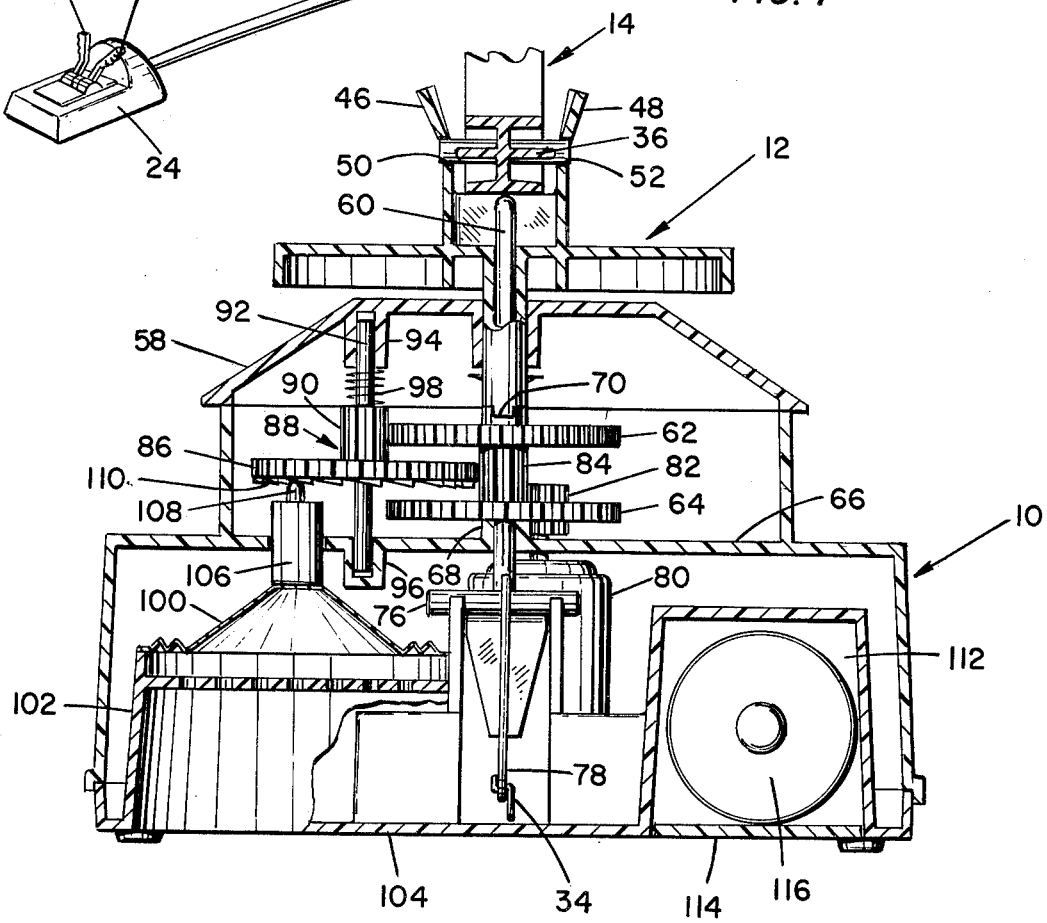
FIG. 4 is an end view of the pylon base housing with portions thereof in cross section and portions broken away.

As will hereinafter be described, the altitude control rod 60 serves a two-fold purpose, one being to effect pivoting of boom 14 to change the altitude of airplane 20, and the other function being to serve as a pivot shaft for a drive gear 62 and a reduction gear 64, each of which is mounted for rotation within the upper portion of base housing 10 about the same axis, this axis being the altitude control rod 60. As shown in FIGS. 2 and 4, the interior of base housing 10 is provided with an upper compartment formed by a partition 66 which is provided with an upwardly extending bushing member 68 on which rests reduction gear 64. The drive gear 62 has the hub portion thereof in the form of a dog 70 for matingly engaging with a similarly configured dog in the hub portion 13 of turntable 12. Disposed beneath the aligned apertures through which the altitude control rod 60 passes is one end 72 of a bell crank member 74 which is pivotally coupled at 76 within the lower portion of base housing 10. The other end 78 of bell crank member 74 is configured for receiving wire control member 34 for pivoting bell crank 74 from the solid line to the dotted line position shown in FIG. 2. Also mounted within the lower portion of base housing 10 is a battery operated electrical motor 80 having the pinion gear 82 thereof in meshing engagement with the reduction gear.

Referring to FIG. 4, the driving mechanism will now be discussed. As can be seen, the reduction gear 64 is driven by the motor pinion gear 82 with the reduction gear 64 having a pinion portion 84 engaging the large diameter portion 86 of an intermediate gear member 88 which has a pinion gear portion 90 engaging drive gear 62. The intermediate gear member 88 is rotatably coupled within the upper portion of housing 10 by means of a shaft 92 engaging aligned bosses 94 and 96 respectively formed in the housing cover 58 and partition 66 respectively. A coil spring 98 encircles a portion of the shaft 92 intermediate the pinion gear 90 and boss 94 to provide a floating mount for intermediate gear member 88 with the urging of spring 98 being in the downward direction.

A sounding mechanism is included within the pylon base housing 10, the sounding mechanism including a sound cone 100 having the perimeter thereof secured to a sound cone housing portion 102 formed integrally in the bottom 104 of housing 10. The sound cone 100 is provided with a centrally disposed upwardly extending piston receiving portion 106 having a sound producing piston 108 extending upwardly therefrom for engaging the lower surface of the large diameter portion 86 of intermediate gear member 88 which as configured has a circumferential ratchet surface 110, the surface 110 vibrating against piston 108 to emit sound from sound cone 100 to simulate the sound of the motor of an airplane. The sound would of course be proportional to the speed of rotation of gear member 88 to thereby create a higher pitched sound for higher speeds and conversely a lower pitched sound for lower speeds. The bottom 104 of housing 10 is also configured to form a battery receiving compartment 112 with an appropriate cover plate 114 for retaining batteries 116 therein.

Figure 3:
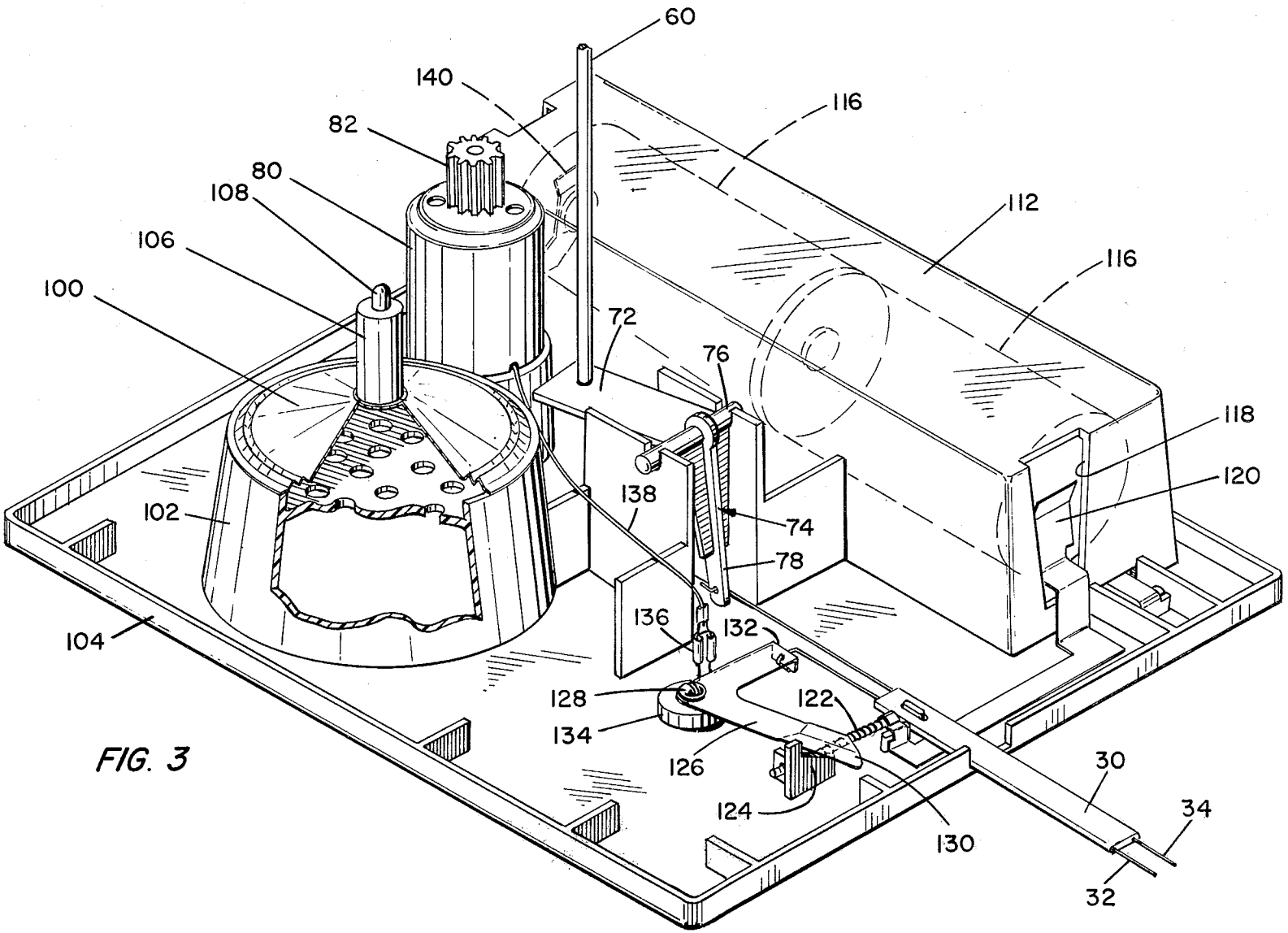
FIG. 3 is a perspective view of the pylon base housing with certain components removed and partially broken away to depict interior details.

As better illustrated in FIG. 3, the electrical control is effected in the following manner. The battery compartment 112 has an open end 118 adjacent one end thereof for providing electrical access to the battery 116 by a spring contact 120 which is suitably secured within the interior of bottom 104. The other end of contact 120 is electrically connected to one end of a rod-shaped slide wire 122 which has the other end thereof secured to a shut-off ramp member 124. A generally L-shaped wiper arm 126 is pivotally coupled at its elbow 128 to the inner surface of the bottom 104 for pivoting in a plane generally parallel to the plane of the bottom 104. The wiper arm 126 is formed of a spring type material such as brass with one arm 130 in wiping electrical engagement with the slide wire 122 to thereby form a slide wire rheostat. The other free end 132 of wiper arm member 126 is suitably bent with an aperture therein for receiving a bent portion of the wire control member 32. As the wire control member 32 is withdrawn into plastic tube 30 the end 130 of wiper arm 126 brushes across the slide wire 122 from right to left as viewed in FIG. 3 until the edge 130 abuts the ramp portion of ramp member 124 thereby elevating the end 130 out of contact with slide wire 122 thereby operating as a shut-off switch. The ramp member 124 is made of electrically insulating material. The elbow 128 of wiper arm 126 is provided with an intermediate conductive washer member 134 which is configured for receiving an electrical connector 136 which is coupled by an electrical lead 138 to one lead of the motor 80. The other lead of motor 80 is coupled to the spring contact 140 at the opposite end of battery compartment 112 for engaging the opposite pole of battery 116 to thereby complete the electrical circuit. Control is then effected in the speed of the motor by the slide wire rheostat formed from slide wire 122 and wiper arm 126. In operation, as the end 130 of wiper arm 126 moves downwardly along ramp member 124 electrical contact will be made between end 130 and slide wire 122 with the maximum amount of resistance in the circuit. As the end 130 moves from left to right as viewed in FIG. 3, the amount of resistance from slide wire 122 will thereby decrease, effectively increasing the speed of motor 80.

Figure 7:
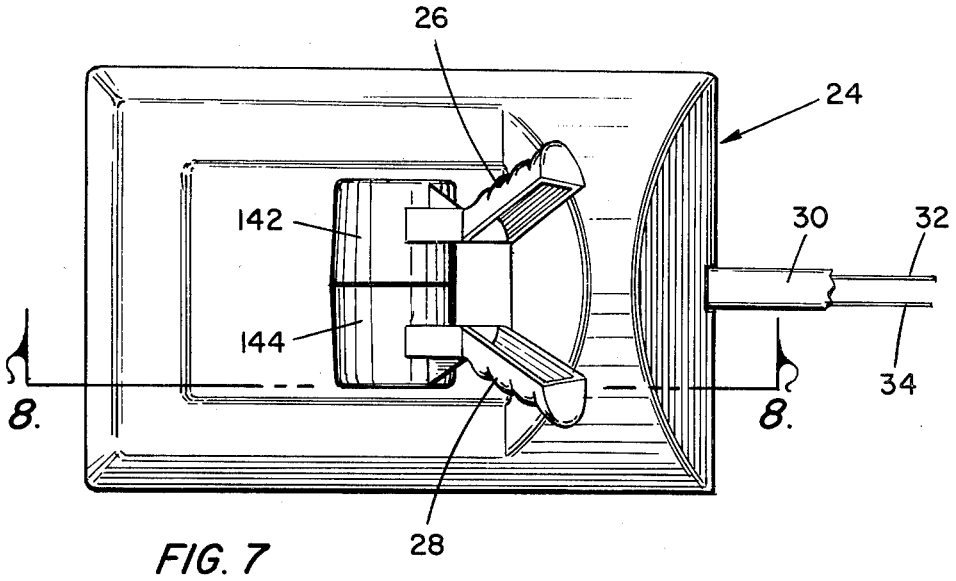
FIG. 7 is a top plan view of the control housing used in the captive flying toy airplane of FIG. 1.
Figure 8:
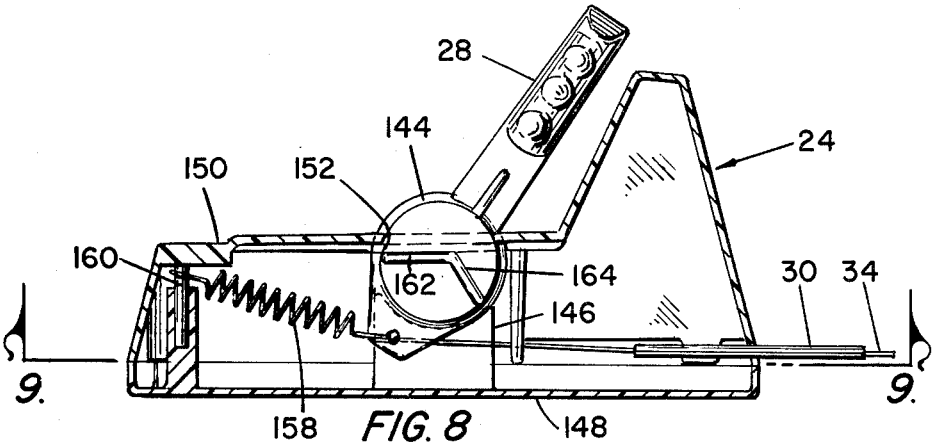
FIG. 8 is a sectional view of the controller housing as viewed generally along line 8—8 of FIG. 7.
Figure 9:
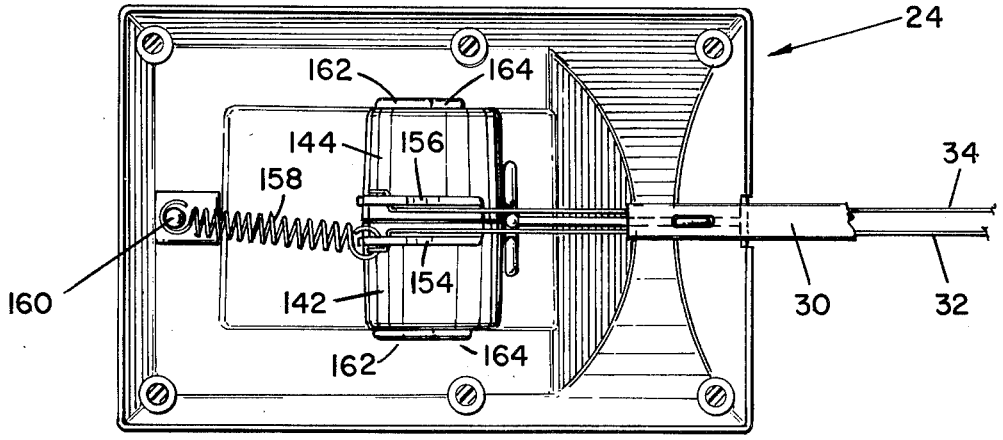
FIG. 9 is a bottom view of the controller housing as viewed generally along line 9—9 of FIG. 8.

Referring now to FIGS. 7–9 the construction of the control housing 24 will be discussed. Each of the control handles 26 and 28 has an integrally formed generally circular enlarged cup shaped portion 142 and 144 respectively which are received within bearing edges 146 (only one of which is shown) formed on the interior of bottom 148 of control housing 24. The upper surface 150 of control housing 128 is provided with a generally rectangular slot 152 through which a portion of the enlarged portions 142 and 144 pass with the spacing between surface 150 and bearing edges 146 in the assembled position being sufficient to maintain the control handles 26 and 28 within housing 24 while permitting rotation of each of the control handles. The lower edge of cup shaped portions 142 and 144 within housing 24 are provided with downwardly extending tab portions 154 and 156 respectively, each having an aperture therethrough for receiving the bent portion of wire control members 32 and 34 respectively. The control handle 26 is the motor speed adjustment control and to provide means for de-energizing the circuit when the toy is not in use, the tab 154 of the enlarged cup shaped portion 142 of handle 26 receives one end of a spring 158, the other end of which is coupled to a stud 160 formed on the interior of housing 24 thereby urging the handle 26 to the position shown in FIG. 8 which is the off position of the motor. Furthermore, to prevent excessive rotation of the control handles, referring to FIG. 8, the closed end of cup shaped portion 144 of control handle 28 is provided with outwardly extending stop ridges 162 and 164, each of which is generally bar shaped with an angular displacement therebetween to provide limits of movement of the control handle 28 with the ridges 162 and 164 abuttingly engaging the undersurface of surface 150 during pivoting of control handle 28.

Likewise, as can be seen in plan view of FIG. 9, the opposing closed surface of cup shaped portion 142 of control handle 26 is also provided with the stop ridges 162 and 164. The plastic tube 30 is fixedly retained with a portion thereof extending into control housing 24 to effect the operations to be hereinafter described.

Referring now to FIGS. 5 and 6, the details pertaining to the coupling member 22 will now be described. The coupling member 22 is a two part coupler, the front part of which has a generally cup-shaped portion 166 with a flange 168 formed adjacent to the open end therof stepped inwardly slightly to form a shoulder portion 170. The closed end of cup-shaped portion 166 has a bent rod portion 172 for inserting within an aperture 174 formed in the fuselage of airplane 20. A pair of aligned slots 176 are formed in the cup-shaped portion 166 for coupling purposes. The second portion of coupling member 22 has a cup-shaped portion 178 with a flange 180 formed adjacent to the open end thereof with a pair of tang members 182 extending axially outwardly for engaging the slots 176 in the first coupling portion. The free end of wire tether 18 is configured in the form of a loop 190 which is received over the shoulder 170 with the two parts then being urged together to retain the loop 190 intermediate flange portions 168 and 180. The closed end of cup-shaped portion 178 is provided with a bent rod portion 184 configured for frictionally engaging an aperture 186 formed adjacent the cockpit of airplane 20 with the coupling member 22 thus configured, assembly is relatively easy and the coupling member 22 is able to release the airplane 20 upon significant impact of the airplane 20 with an object.

With the airplane 20 thus assembled to loop 190 of tether wire 18, and tether wire 18 secured to boom 14, the captive toy flying airplane is then ready for operation. Referring specifically to FIG. 2, with the pivot 36 of boom 14 offset or displaced radially from the center of rotation of turntable 12 altitude adjustment of airplane 20 is effected by vertical adjustment of altitude control rod 60. Initially, the weight of counterweight 16 on arm 40 of the boom 14 is more than enough to offset the weight of the airplane 20 to thereby urge arm 14 downwardly as viewed in FIG. 2. The altitude control rod 60 is maintained in the last position of control handle 28 by virtue of the friction existing between the wire control rod 34 within tube 30. The control rod 60 is circular in outer dimension with respective apertures within turntable 12, drive gear 62 and reduction gear 64 being likewise circular to enable the respective rotating components to rotate about altitude control rod 60 freely since gears 62 and 64 will not be rotating simultaneously.

Assuming the toy is placed in the dotted line position shown in FIG. 2, the child then operates control handle 26 against the force of its bias spring 158 (See FIG. 8) to thereby urge wire control member 32 out of tube 30 to thereby pivot wiper arm 126 off of insulating lamp member 124 to thereby complete the electrical circuit upon contact of the end 130 with the slide wire 122 thereby driving motor 80. During the rotation of motor 80, as shown in FIG. 4, the pinion 82 drives intermediate gear 64, the pinion portion 84 thereof driving the intermediate gear member 88. The ratchet toothed peripheral portion 110 of gear member 88 thus generates a sound which is transmitted through sound cone 100 to simulate the noise of the airplane. The driving of intermediate gear member 88 thus drives drive gear 62 which thereby rotates turntable 12 which is locked thereto for concurrent movement therewith. The speed of rotation can thus be affected by means of the control handle 26. If the child desires to increase the altitude of the airplane 20 from the dotted line position to the solid line position shown in FIG. 2, the control handle 28 is pushed forwardly to draw control wire member 34 rearwardly through tube 30 to thereby let bell crank 74 pivot to the solid line position shown in FIG. 2 with the weight of counterweight 16 urging arm 40 downwardly against altitude control rod 60. The lower end of altitude control rod 60 rests on the end 72 of bell crank 74. Consequently, the construction and operation of the captive flying toy airplane according to the invention is simple and efficient.

While there has been shown and described a preferred embodiment it is to be understood that various other adaptations and modifications may be made within the spirit and scope of the invention.

What is claimed is:

1. A captive flying toy comprising:

a pylon having a turntable configured for rotation about a first axis;

a boom member having first and second ends;

means coupling said boom member to said turntable for pivoting about a second axis generally transverse to said first axis;

a toy member secured to one of said first and second ends of said boom member;

a counterweight member secured to the other of said first and second ends of said boom member;

a rod member extending through said turntable, one end of said rod member engaging said boom member;

electrically operated drive means for rotating said turntable, said drive means including at least one gear member coupled for rotation about said rod member and another gear member in said drive means, said another gear member having a circumferential ratchet surface;

a sound cone mounted within said pylon and having the apex portion thereof engaging said ratchet surface for emitting a sound having a frequency proportional to the speed of rotation of said another gear member;

a bell crank member engaging the other end of said rod member for displacing said rod member axially for pivoting said boom member against the force of said counterweight; and a control member coupled to said bell crank member for pivoting the same.

2. The combination according to claim 1 wherein said toy further includes a control housing having first and second control handles and relatively flexible means interconnecting said control housing with said pylon and control members coupled to said first and second handles passing through said relatively flexible means, one of said control members being coupled to said bell crank member and the other of said control members being coupled to means for controlling the speed of said electrical motor.

3. The combination according to claim 2 wherein said other control member controls the wiper arm of a slide wire rheostat electrically connected to said electrical motor.

4. The combination according to claim 3 wherein said second axis is offset from said first axis and wherein said rod member extends through said turntable on said first axis.

* * * * *